US011097533B2

(12) United States Patent
Arakane et al.

(10) Patent No.: US 11,097,533 B2
(45) Date of Patent: Aug. 24, 2021

(54) IMAGE FORMING SYSTEM

(71) Applicant: BROTHER KOGYO KABUSHIKI KAISHA, Nagoya (JP)

(72) Inventors: Satoru Arakane, Nagoya (JP); Yuta Arakawa, Nagoya (JP); Yusuke Arai, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/575,502

(22) Filed: Sep. 19, 2019

(65) Prior Publication Data

US 2020/0101720 A1 Apr. 2, 2020

(30) Foreign Application Priority Data

Sep. 28, 2018 (JP) ..... JP2018-184138

(51) Int. Cl.

| | |
|---|---|
| ***B41J 29/38*** | (2006.01) |
| ***B41J 19/20*** | (2006.01) |
| ***B41J 13/00*** | (2006.01) |
| ***B41J 2/045*** | (2006.01) |
| ***B41J 13/08*** | (2006.01) |

(52) U.S. Cl.

CPC ..... *B41J 2/04505* (2013.01); *B41J 2/04555* (2013.01); *B41J 13/0009* (2013.01); *B41J 13/08* (2013.01); *B41J 19/202* (2013.01); *B41J 29/38* (2013.01)

(58) Field of Classification Search

CPC .... B41J 2/04505; B41J 2/04555; B41J 13/08; B41J 13/0009; B41J 29/38; B41J 19/202

See application file for complete search history.

(56) References Cited

U.S. PATENT DOCUMENTS

2018/0118037 A1* 5/2018 Ueo ..... B60W 50/04

FOREIGN PATENT DOCUMENTS

| | | | | |
|---|---|---|---|---|
| JP | 2001-001592 A | | 1/2001 | |
| JP | 2001-232882 A | | 8/2001 | |
| JP | 2004-202713 A | | 7/2004 | |
| JP | 2008-080669 A | | 4/2008 | |
| JP | 2008080669 A | * | 4/2008 | ..... B41J 2/01 |

* cited by examiner

*Primary Examiner* — Yaovi M Ameh

(74) *Attorney, Agent, or Firm* — Scully Scott Murphy and Presser

(57) ABSTRACT

A controller is configured to: when both a first conveyor and a second conveyor are operating concurrently, determine whether a reference current value exceeds a threshold value, the reference current value being obtained based on at least one of a first driving current that is a driving current of the first conveyor and a second driving current that is a driving current of the second conveyor; in response to determining that the reference current value exceeds the threshold value, continue an operation of an earlier-driven conveyor that is one of the first conveyor and the second conveyor that is started at earlier timing, and temporarily stop an operation of a later-driven conveyor that is one of the first conveyor and the second conveyor that is started at later timing; and after a driving current of the earlier-driven conveyor drops to a particular standard, restart the operation of the later-driven conveyor.

16 Claims, 7 Drawing Sheets

IMAGE FORMING SYSTEM

CROSS REFERENCE TO RELATED APPLICATIONS

This application claims priority from Japanese Patent Application No. 2018-184138 filed Sep. 28, 2018. The entire content of the priority application is incorporated herein by reference.

TECHNICAL FIELD

This disclosure relates to an image forming system.

BACKGROUND

As an image forming system, an inkjet printer that forms an image on a sheet by ejecting ink is conventionally known. Normally, an inkjet printer forms an image on a sheet by reciprocating a carriage on which an inkjet head is mounted along a main scanning direction and by intermittently conveying the sheet in a sub-scanning direction. Ejection of ink is performed while conveying the carriage when the sheet is stopped.

SUMMARY

According to one aspect, this specification discloses an image forming system. The image forming system includes an ejector, a first conveyor, a second conveyor, a common power supply, and a controller. The ejector is configured to eject ink toward a sheet. The first conveyor is configured to cause the ejector to reciprocate along a main scanning direction. The second conveyor is configured to convey the sheet in a sub-scanning direction. The common power supply is configured to supply electric power to the first conveyor and the second conveyor. The controller is configured to form an image on the sheet by repeatedly performing operations of controlling the first conveyor to convey the ejector to a turn position along the main scanning direction, controlling the ejector to eject ink toward the sheet in a conveyance process of the ejector, and controlling the second conveyor to convey the sheet in the sub-scanning direction by a particular amount after ejection of ink by the ejector ends. The controller is configured to: when both the first conveyor and the second conveyor are operating concurrently, determine whether a reference current value exceeds a threshold value, the reference current value being obtained based on at least one of a first driving current that is a driving current of the first conveyor and a second driving current that is a driving current of the second conveyor; in response to determining that the reference current value exceeds the threshold value, continue an operation of an earlier-driven conveyor that is one of the first conveyor and the second conveyor that is started at earlier timing, and temporarily stop an operation of a later-driven conveyor that is one of the first conveyor and the second conveyor that is started at later timing; and after a driving current of the earlier-driven conveyor drops to a particular standard, restart the operation of the later-driven conveyor.

BRIEF DESCRIPTION OF THE DRAWINGS

Embodiments in accordance with this disclosure will be described in detail with reference to the following figures wherein.

DETAILED DESCRIPTION

In order to improve throughput of printing, it is also known that, at timing when ink ejection ends during carriage conveyance on the way to the turn position, conveyance of the sheet is started without waiting for the carriage to reach the turn position. It is also known that conveyance of the carriage is started before the sheet conveyance operation ends.

This overlapped conveyance operation requires concurrently supplying driving currents to the carriage conveyance mechanism and the sheet conveyance mechanism. Hence, in a conventional system, a power supply having a large suppliable current that can concurrently supply driving currents is adopted as a common power supply.

However, a power supply having a large suppliable current is more expensive than a power supply having a small suppliable current. On the other hand, if a small power supply having a small suppliable current is adopted in order to reduce the manufacturing cost, there is a possibility that a required driving current exceeds a suppliable current during overlapped conveyance operations.

In view of the foregoing, an aspect of an object of this disclosure is to provide technique for appropriately operating a plurality of conveyance mechanisms by using a common power supply having a small suppliable current in an image forming system.

Some aspects of this disclosure will be described while referring to the attached drawings.

Some aspects of this disclosure will be described while referring to the attached drawings.

Figure 1:
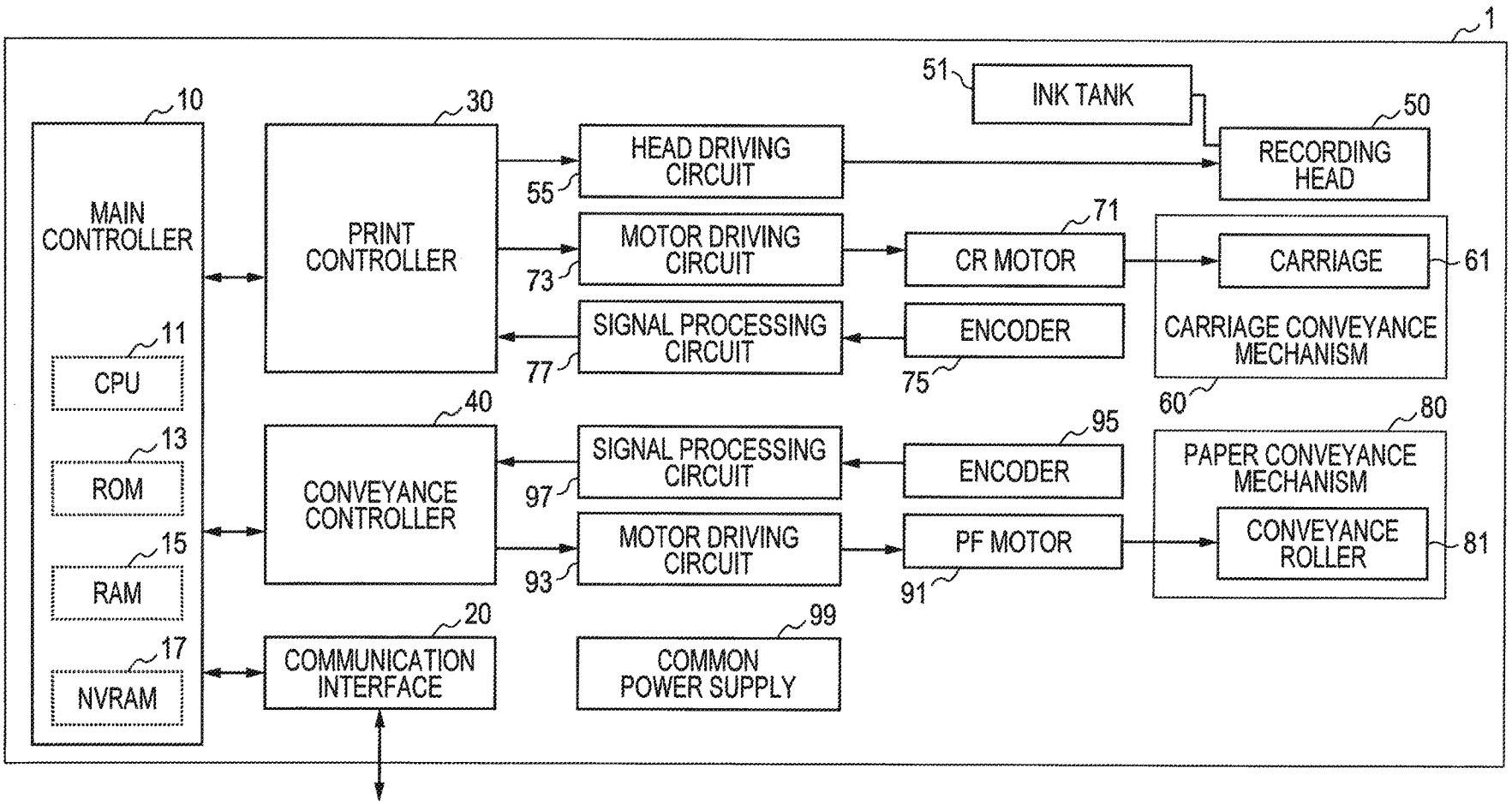
FIG. 1 is a block diagram showing the configuration of an image forming system.

An image forming system 1 of the present embodiment shown in FIG. 1 is configured as an inkjet printer. The image forming system 1 includes a main controller 10, a communication interface 20, a print controller 30, and a conveyance controller 40.

The main controller 10 includes a CPU 11, a ROM 13, a RAM 15, and an NVRAM 17. The ROM 13 stores programs. The CPU 11 executes processing in accordance with the programs stored in the ROM 13, thereby performs overall control of each section in the image forming system 1.

The RAM 15 is used as a work area when the CPU 11 executes processing. The NVRAM 17 is an electrically rewritable memory and may be a flash memory or an EEPROM. The NVRAM 17 stores data that needs to be kept even during power off.

The communication interface 20 is configured to perform data communication with an external apparatus, and receives print target data from the external apparatus, for example. In accordance with commands from the main controller 10, the print controller 30 controls conveyance of a carriage 61 on which a recording head 50 is mounted, and further controls an ink ejection operation by the recording head 50. Due to this control, the print controller 30 forms an image based on print target data on paper Q. In one example, the print controller 30 and the conveyance controller 40 are formed as an ASIC.

As elements relating to an image formation operation, the image forming system 1 includes the recording head 50, an ink tank 51, a head driving circuit 55, a carriage conveyance mechanism 60, a CR (carriage) motor 71, a motor driving circuit 73, an encoder 75, and a signal processing circuit 77 in addition to the print controller 30.

The recording head 50 is an inkjet head that ejects ink toward paper Q. The recording head 50 is mounted on the carriage 61. The recording head 50 is connected to the ink tank 51 that is not mounted on the carriage 61 through a tube (not shown), and operates by receiving ink supply from the ink tank 51. The recording head 50 is also connected to a signal line (not shown).

The head driving circuit 55 is configured to drive the recording head 50 in accordance with control signals inputted from the print controller 30. The carriage conveyance mechanism 60 is configured to cause the carriage 61 to reciprocate along the main scanning direction by transmitting power from the CR motor 71 to the carriage 61. The detailed configuration of the carriage conveyance mechanism 60 will be described while referring to FIG. 2.

The CR motor 71 may be a direct-current motor. The motor driving circuit 73 drives the CR motor 71 by PWM control. Specifically, the motor driving circuit 73 applies, to the CR motor 71, a driving current in accordance with an input signal from the print controller 30, and drives the CR motor 71.

The encoder 75 is a linear encoder configured to output encoder signals depending on displacement of the carriage 61 in the main scanning direction. The signal processing circuit 77 detects the position and velocity of the carriage 61 in the main scanning direction, based on encoder signals inputted from the encoder 75. The position and velocity of the carriage 61 detected by the signal processing circuit 77 are inputted to the print controller 30.

The print controller 30 determines a manipulated variable for the CR motor 71 such that the carriage 61 moves in accordance with a target position and a velocity locus that follows a command from the main controller 10, based on the position and velocity of the carriage 61 inputted from the signal processing circuit 77, and inputs a corresponding control signal to the motor driving circuit 73. With this operation, the print controller 30 controls the CR motor 71 so as to realize conveyance control that follows the command from the main controller 10.

Further, the print controller 30 inputs, to the head driving circuit 55, a control signal for realizing ink ejection control corresponding to input data from the main controller 10, based on the position of the carriage 61 inputted from the signal processing circuit 77. With this operation, the recording head 50 ejects ink, onto paper Q, for forming an image corresponding to print target data at appropriate timing.

The conveyance controller 40 controls a PF (paper feed) motor 91 in accordance with commands from the main controller 10, thereby controlling conveyance of paper Q. As elements relating to conveyance of paper Q, the image forming system 1 includes a paper conveyance mechanism 80, the PF motor 91, a motor driving circuit 93, an encoder 95, and a signal processing circuit 97.

The paper conveyance mechanism 80 receives power from the PF motor 91 and causes a conveyance roller 81 to rotate, thereby conveying paper Q in a sub-scanning direction perpendicular to the main scanning direction. With this operation, the paper conveyance mechanism 80 feeds paper Q, by a particular amount at a time, to a position in the sub-scanning direction at which the recording head 50 reciprocates.

The PF motor 91 may be a direct-current motor. The motor driving circuit 93 applies, to the PF motor 91, a driving current in accordance with an input signal from the conveyance controller 40, thereby driving the PF motor 91.

The encoder 95 is a rotary encoder provided at a rotational shaft of the PF motor 91 or the conveyance roller 81 and configured to output encoder signals depending on rotation of the PF motor 91 or the conveyance roller 81.

The signal processing circuit 97 detects a rotation amount and a rotation velocity of the conveyance roller 81 based on the encoder signal inputted from the encoder 95. The rotation amount and the rotation velocity of the conveyance roller 81 correspond to the conveyance amount and the conveyance velocity of paper Q conveyed due to rotation of the conveyance roller 81.

The rotation amount and the rotation velocity detected by the signal processing circuit 97 are inputted to the conveyance controller 40. The conveyance controller 40 determines a manipulated variable for the PF motor 91 based on the rotation amount and the rotation velocity detected by the signal processing circuit 97, and controls the PF motor 91. With this operation, the conveyance controller 40 controls rotation of the conveyance roller 81, thereby controlling conveyance of paper Q.

Figure 2:
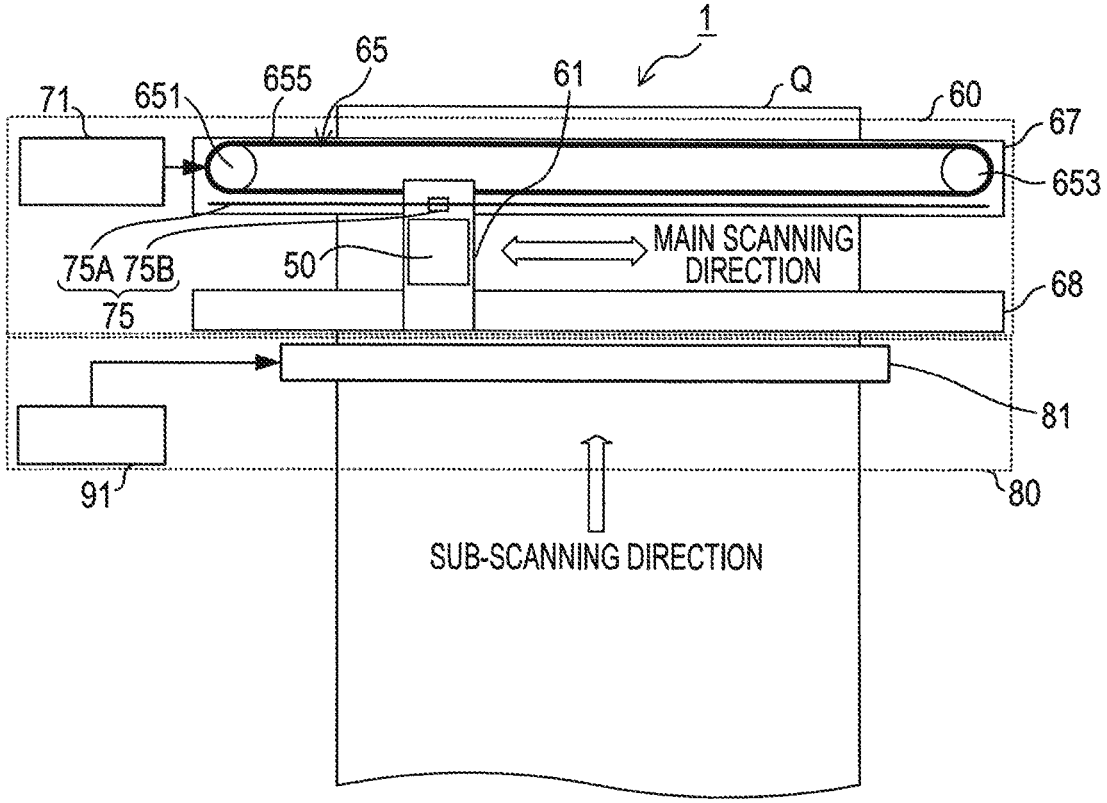
FIG. 2 is a diagram showing the configuration of a carriage conveyance mechanism and a paper conveyance mechanism.

As shown in FIG. 2, the carriage conveyance mechanism 60 includes the carriage 61, a belt mechanism 65, and guide rails 67, 68. The belt mechanism 65 includes a drive pulley 651 and a follow pulley 653 arranged in the main scanning direction, and a belt 655 looped between the drive pulley 651 and the follow pulley 653. The carriage 61 is fixed to the belt 655. In the belt mechanism 65, the drive pulley 651 rotates by receiving power from the CR motor 71, and the belt 655 and the follow pulley 653 rotate by following rotation of the drive pulley 651.

The guide rails 67, 68 extend along the main scanning direction, and arranged at positions away from each other in the sub-scanning direction. The belt mechanism 65 is disposed at the guide rail 67. For example, a protruding wall (not shown) extending along the main scanning direction is formed on the guide rails 67, 68 in order to regulate the movement direction of the carriage 61 in the main scanning direction.

In a state where the movement direction of the carriage 61 is regulated by the guide rails 67, 68, the carriage 61 reciprocates on the guide rails 67, 68 along the main scanning direction in conjunction with rotation of the belt 655. The recording head 50 is mounted on the carriage 61, and moves in the main scanning direction due to movement of the carriage 61.

The conveyance roller 81 is arranged to be parallel with the main scanning direction at an upstream side of the recording head 50 in the sub-scanning direction. The conveyance roller 81 rotates by receiving power from the PF motor 91 and, by this rotation, conveys paper Q conveyed from the upstream side to the downstream side in the sub-scanning direction.

Specifically, the conveyance roller 81 is indirectly controlled by the conveyance controller 40 through the PF motor 91, and intermittently and repeatedly executes an operation of rotating by a particular amount, thereby conveying paper Q to the downstream side in the sub-scanning direction by a particular amount at a time. The paper conveyance mechanism 80 includes a paper feed roller (not shown) at the upstream side of the conveyance roller 81. The paper feed roller picks up paper Q from a tray and conveys the paper Q to the downstream side.

As shown in FIG. 2, the encoder 75 includes an encoder scale 75A and an optical sensor 75B. The encoder scale 75A is disposed at the guide rail 67 along the main scanning direction. The optical sensor 75B is mounted on the carriage 61. The encoder 75 inputs, to the signal processing circuit 77, encoder signals depending on change of a relative position between the encoder scale 75A and the optical sensor 75B.

Each unit of the above-described image forming system 1 operates by receiving power supply from a common power supply 99 provided in the image forming system 1. For example, the CR motor 71 and the PF motor 91 operate by receiving power supply from the common power supply 99 through the motor driving circuits 73, 93.

Figure 3:
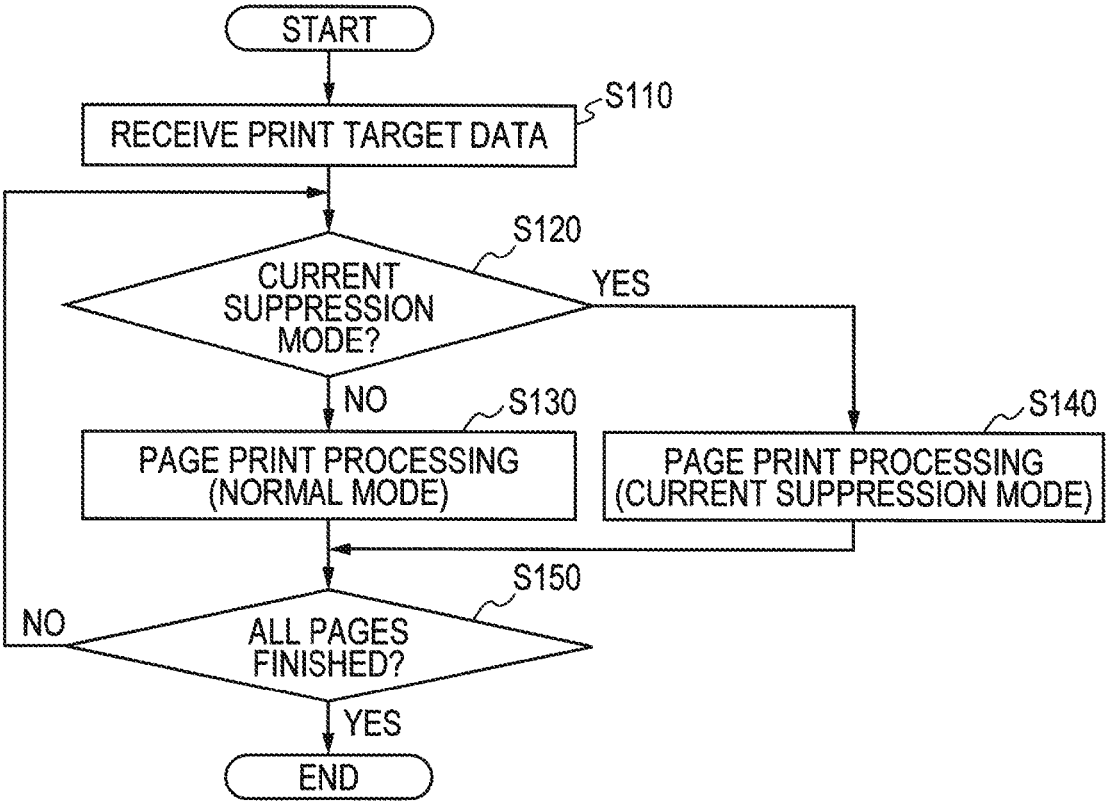
FIG. 3 is a flowchart showing processing that is executed by a main controller in response to receiving a print command.

Next, the details of processing executed by the main controller 10 in response to receiving a print command from the external apparatus through the communication interface 20 will be described while referring to FIG. 3. In response to receiving a print command, the main controller 10 receives print target data from the external apparatus (S110).

After that, the main controller 10 determines whether an operation mode is set to a current suppression mode (S120). In response to determining that the operation mode is not set to the current suppression mode (S120: No), the main controller 10 moves to S130 and executes page print processing for a normal mode.

Figure 4:
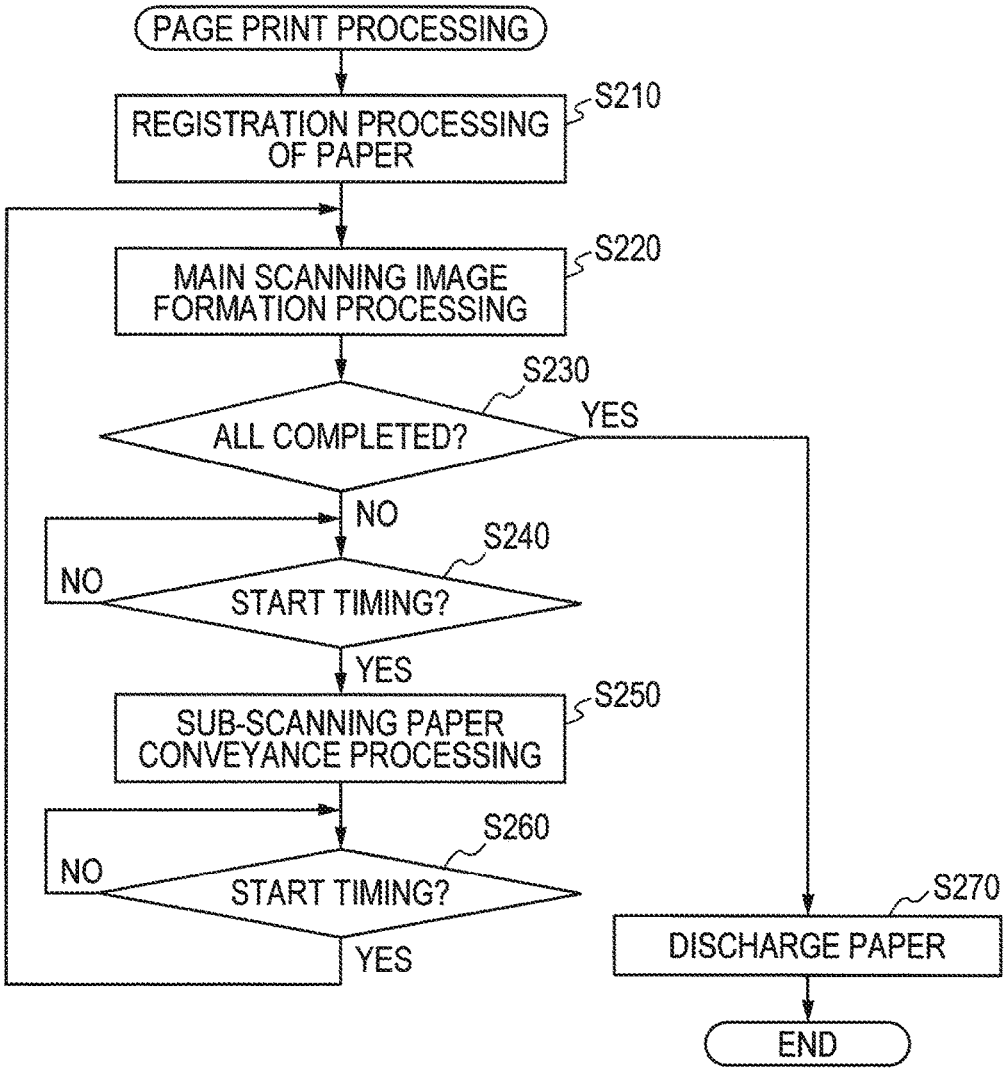
FIG. 4 is a flowchart showing page print processing that is executed by the main controller.

In response to determining that the operation mode is set to the current suppression mode (S120: Yes), the main controller 10 moves to S140 and executes page print processing for the current suppression mode. The page print processing performed in S130 and S140 is shown in FIG. 4. The page print processing is executed to form an image for one page based on print target data on one sheet of paper Q. The page print processing is executed once for each page, that is, once on each sheet of paper Q.

When the page print processing in S130 and S140 ends, the main controller 10 determines whether page print processing for all pages has ended (S150). In response to determining that page print processing for all pages has not ended (S150: No), the main controller 10 moves to S120 and, after determining the currently-set operation mode, executes page print processing corresponding to the currently-set operation mode as page print processing for the next page (S130 or S140).

As described above, the main controller 10 executes page print processing for each page until page print processing for all pages ends. After that, the main controller 10 makes a positive determination in S150 and ends the processing shown in FIG. 3.

As shown in FIG. 4, in the page print processing, the main controller 10 first executes registration processing of paper Q (S210). In registration processing, the main controller 10 inputs a command to the conveyance controller 40 such that the paper conveyance mechanism 80 conveys paper Q to the downstream side in the sub-scanning direction and a leading end of an image formation target region of paper Q in the sub-scanning direction is located below the recording head 50.

The main controller 10 sets, to the conveyance controller 40, a target profile indicative of the target position and the velocity locus of the conveyance roller 81, and causes the conveyance controller 40 to control the PF motor 91 such that the conveyance roller 81 rotates in accordance with the position and the velocity locus that follows the target profile, thereby realizing registration of paper Q.

In response to completing the registration processing, in the following S220-S260, the main controller 10 executes main-scanning image formation processing of causing the carriage conveyance mechanism 60 to convey the recording head 50 to the turn position for one pass along the main scanning direction, in the conveyance process of the recording head 50, causing the recording head 50 to eject ink toward paper Q in a stopped state. Further, the main controller 10 executes sub-scanning paper conveyance processing of, after the recording head 50 ends ink ejection, causing the paper conveyance mechanism 80 to convey the paper Q by a particular amount in the sub-scanning direction. By repeatedly performing the main-scanning image formation processing and the sub-scanning paper conveyance processing, an image based on print target data is formed on paper Q.

That is, the main controller 10 forms an image based on print target data on paper Q by, while intermittently conveying the paper Q by the particular amount, causing, during stop time of the paper Q, the recording head 50 to perform an ink ejection operation along the main scanning direction. The conveyance amount of paper Q in the intermittent conveyance (the above-mentioned particular amount) corresponds to a width of an image, in the sub-scanning direction, formed by the ink ejection operation along the main scanning direction.

In the following description, a one-way conveyance operation of the carriage 61 and an ink ejection operation for one pass performed by the main scanning image formation processing are expressed as an image formation operation for one pass or a main scanning image formation operation. The conveyance operation of paper Q for a particular amount performed by the sub-scanning sheet conveyance processing is expressed as a paper conveyance operation for one pass or a sub-scanning paper conveyance operation.

The main controller 10 executes the main scanning image formation processing in S220. In the main scanning image formation processing, the main controller 10 sets a target profile indicating a target position and a velocity locus for the print controller 30. According to this target profile, the carriage 61 accelerates to a particular velocity from a stopped position and moves at a constant velocity at the particular velocity until reaching a deceleration start position. Then, the carriage 61 begins to decelerate after leaving the deceleration start position and the main controller 10 causes the print controller 30 to control the CR motor 71 and the carriage conveyance mechanism 60 such that the carriage 61 stops at a turn position. In this way, the carriage 61 is conveyed to the turn position along the main scanning direction.

The main controller 10 further inputs, to the print controller 30, ejection control data on the image that is based on the print target data and is to be formed on the paper Q by the image formation operation for one pass. As a result, the main controller 10 causes the print controller 30 to control the recording head 50 such that the recording head 50 performs the ink ejection operation based on the input data in an image formation target section between an image formation start position and an image formation end position in the conveyance process of the carriage 61.

As in a known inkjet printer, in order to control an ink landing point on paper Q, an ink ejection operation is performed on stopped paper Q in a state where the carriage 61 is conveyed at a constant velocity. That is, the image formation target section is within a constant-velocity conveyance section of the carriage 61.

In this way, in S220, the main controller 10 controls the carriage conveyance mechanism 60 to convey the carriage 61 to the turn position for one way along the main scanning direction and, during a conveyance process of the carriage 61, cause the recording head 50 to eject ink onto paper Q, thereby realizing an image formation operation for one pass.

After that, the main controller 10 determines whether image formation operations for one page corresponding to print target data received in S110 are all completed in the processing of S220 (S230). In response to determining that the image formation operations are all completed (S230: Yes), the main controller 10 executes paper discharge processing (S270) after the image formation operation for one pass in S220 ends. In the paper discharge processing, the conveyance controller 40 controls the PF motor 91 such that paper Q is discharged from the paper conveyance mechanism 80. Then, the page print processing shown in FIG. 4 ends.

In response to determining that the image formation operations are not all completed (S230: No), the main controller 10 waits until the conveyance start timing of paper Q comes (S240). When the conveyance start timing of paper Q comes (S240: Yes), the main controller 10 executes the sub-scanning paper conveyance processing so as to control the paper conveyance mechanism 80 to convey paper Q in the sub-scanning direction by the particular amount (S250).

In the sub-scanning paper conveyance processing (S250), the main controller 10 sets, to the conveyance controller 40, a target profile indicative of the target position and the velocity locus of the conveyance roller 81, and causes the conveyance controller 40 to start controlling the PF motor 91 in accordance with the target profile set as described above.

Detection that the conveyance start timing of paper Q has come may be realized by receiving information necessary for detection from the print controller 30. The conveyance start timing of paper Q corresponds to timing at which the carriage 61 passes the image formation end position. Thus, the main controller 10 detects that the conveyance start timing of paper Q has come by acquiring positional information of the carriage 61 through the print controller 30.

When the sub-scanning paper conveyance processing is executed and the paper conveyance mechanism 80 starts a conveyance operation of paper Q, in the subsequent S260, the main controller 10 stands by until the conveyance start timing of the carriage 61 comes. When the conveyance start timing of the carriage 61 comes, the main controller 10 executes the above-described main scanning image formation processing for the next pass (S220).

The conveyance start timing of the carriage 61 is set such that the carriage 61 passes the image formation start position immediately after conveyance of paper by the paper conveyance mechanism 80 ends. In other words, the main controller 10 causes the carriage conveyance mechanism 60 to start the conveyance operation of the carriage 61 before the sub-scanning paper conveyance operation ends, and causes the recording head 50 to perform an ink ejection operation immediately after conveyance of the paper Q ends (S220).

The main controller 10 repeatedly performs the main scanning image formation operation and the sub-scanning paper conveyance operation in a partially overlapping manner, to thereby form the image based on the print target data on the paper Q.

In addition, a target profile indicating a maximum target velocity and acceleration, which differ between the normal mode and the current suppression mode, is set in the above-described page print processing. More specifically, in the main scanning image formation processing (S220), a target velocity in a constant velocity section of the carriage 61 is set to a lower value in the current suppression mode than in the normal mode in order to suppress peak driving current of the CR motor 71.

Figure 5:
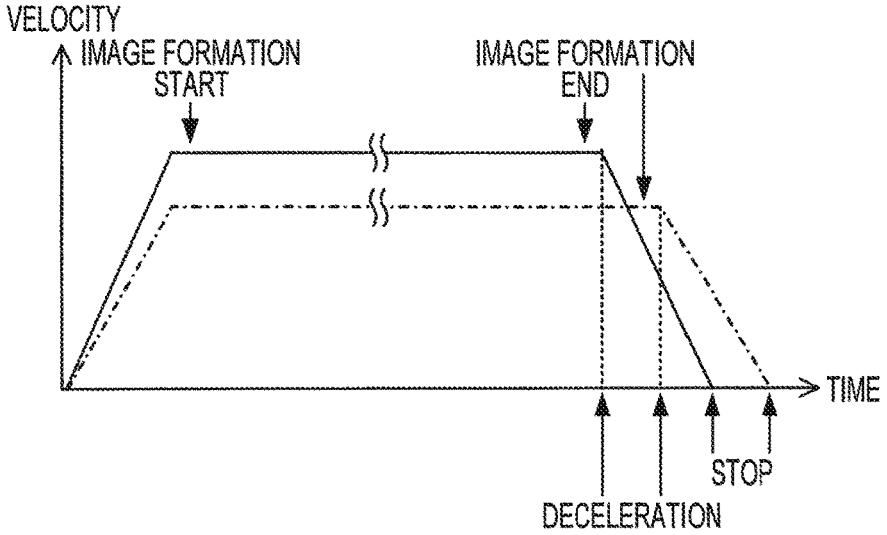
FIG. 5 is a graph of velocity with respect to time showing a velocity locus of the carriage.

Due to this low target velocity, a target acceleration is also set to a lower value in the current suppression mode than in the normal mode. The target acceleration is the slope of the target velocity in the acceleration section that ends when the carriage 61 shifts to a constant velocity state. Similarly, a target deceleration is also set to a lower value in the current suppression mode than in the normal mode. The target deceleration is the slope of the target velocity in the deceleration section in which the carriage 61 decelerates from the constant velocity state and stops. In FIG. 5, the single-dot chain line schematically shows a target velocity locus in the current suppression mode and the solid line schematically shows a target velocity locus in the normal mode.

Similarly, in order to minimize the peak of driving current of the PF motor 91 in the paper conveyance processing (S250), the peak of the target velocity is set to a lower value in the current suppression mode than in the normal mode and, due to this low peak of the target velocity, the peak of the target acceleration is also set to a lower value in the current suppression mode than in the normal mode. In the current suppression mode, the main controller 10 sets, to the conveyance controller 40, a target profile in which the peak of the target velocity and the peak of the target acceleration are reduced by particular amounts relative to the normal mode.

As another example, the page print processing in the current suppression mode may be a type of processing in which the conveyance start timing of the carriage 61 and the conveyance start timing of the paper Q are changed from those in the normal mode. In other words, in the page print processing in the current suppression mode, the main controller 10 may start the sub-scanning paper conveyance processing (S250) and cause the paper conveyance mechanism 80 to convey the paper Q after the carriage 61 has reached the turn position and the CR motor 71 has stopped running. Similarly, the main controller 10 may start the main scanning image formation processing (S220) and cause the carriage conveyance mechanism 60 to convey the carriage 61 after the PF motor 91 has stopped running and the paper Q has stopped. According to this example, the CR motor 71 and the PF motor 91 are driven so as not to operate concurrently. Therefore, the overall current supplied to the CR motor 71 and the PF motor 91 from the common power source 99 is suppressed.

Figure 6:
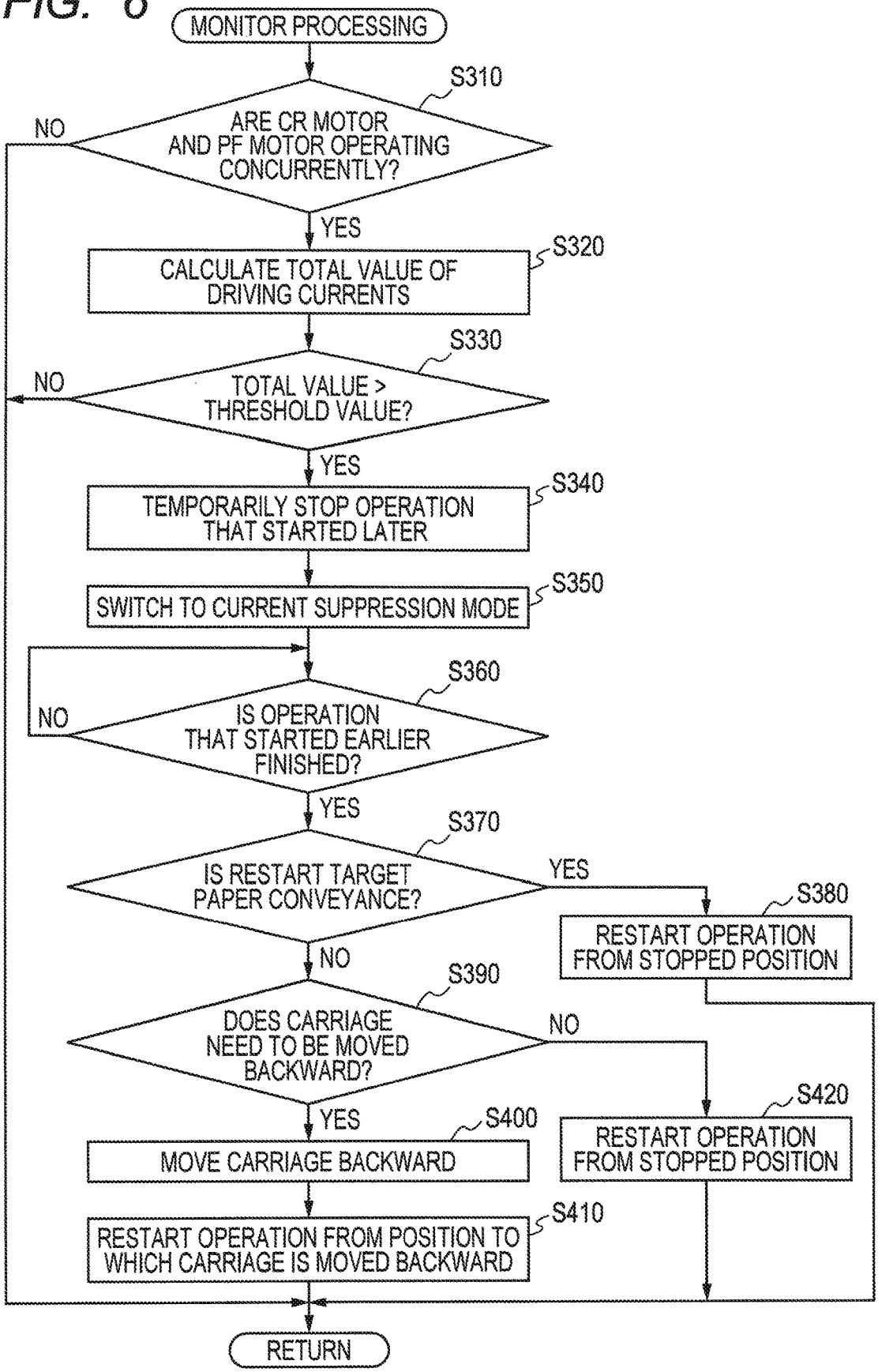
FIG. 6 is a flowchart showing monitor processing that is executed by the main controller.

According to this embodiment, the main controller 10 is further configured to repeatedly perform monitor processing shown in FIG. 6 while executing the page print processing shown in FIG. 4. In the monitor processing, the main controller 10 determines whether the CR motor 71 and the PF motor 91 are concurrently operating (S310).

In response to determining that the CR motor 71 and the PF motor 91 are not operating concurrently (S310: No), the main controller 10 temporarily stops the monitor processing and then executes the monitor processing again. In response to determining that the CR motor 71 and the PF motor 91 are operating concurrently (S310: Yes), the main controller 10 moves to S320.

In S320, the main controller 10 calculates a total value Is=I1+I2 of a driving current I1 that flows through the CR motor 71 and a driving current I2 that flows through the PF motor 91. The print controller 30 provides the main controller 10 with information on the driving current I1 applied to the CR motor 71. Similarly, the conveyance controller 40 provides the main controller 10 with information on the driving current I2 applied to the PF motor 91.

In S330, which follows S320, the main controller 10 determines whether the total value Is is larger than a particular threshold value TH. The threshold value TH is set to a value smaller than a current value at which a fuse blows. Alternatively, the threshold value TH may be set to a value smaller than a current value at which a current protection circuit causes power to shut off. For example, if a current protection circuit (not shown) included in the common power source 99 has a current value of 3.0 amps at which power shuts off, the threshold value TH may be set to 2.8 amps.

In response to determining in S330 that the total value Is is larger than the threshold value TH, the main controller 10 moves to S340. In response to determining in S330 that the total value Is is smaller than or equal to the threshold value TH (S330: No), the main controller 10 temporarily ends the monitor processing.

In S340, the main controller 10 inputs a stop instruction to the print controller 30 or the conveyance controller 40 to temporarily stop whichever operation that is started at later timing among the main scanning image formation operation (S220) including an operation of the CR motor 71 and the sub-scanning paper conveyance operation (S250) including an operation of the PF motor 91.

As described above, in the sub-scanning paper conveyance processing (S250) executed after the ink ejection operation performed by the recording head 50, the PF motor 91 starts up while the CR motor 71 is operating. In this case, the operation that is started at later timing (hereinafter, also referred to as "later-started operation") is the sub-scanning paper conveyance operation and the operation that is started at earlier timing (hereinafter, also referred to as "earlier-started operation") is the main scanning image formation operation. The arrows in FIG. 7A indicate the flow of the main scanning image formation operation and the sub-scanning paper conveyance operation. In this case, the CR motor 71 and the carriage conveyance mechanism 60 are referred to as "earlier-driven conveyor" that is started at earlier timing, and the PF motor 91 and the paper conveyance mechanism 80 are referred to as "later-driven conveyor" that is started at later timing.

Figure 7A:
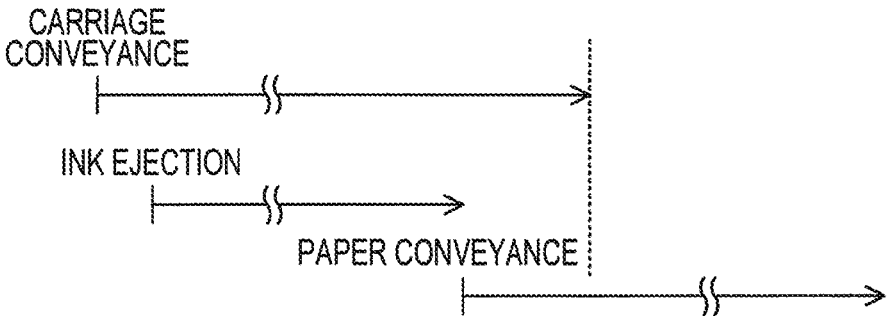
FIG. 7A is an explanatory diagram for illustrating a case where a carriage conveyance operation precedes a paper conveyance operation.

As shown in FIG. 7A, when the main controller 10 executes the main scanning image formation processing (S220), the conveyance operation of the carriage 61 is started and the ink ejection operation performed by the recording head 50 is started when the carriage 61 reaches the image formation start position. Then, the main controller 10 executes the sub-scanning paper conveyance processing (S250) to start the conveyance operation of the paper Q before the conveyance operation of the carriage 61 ends.

In contrast, when the main controller 10 executes the main scanning image formation processing (S220) before the sub-scanning paper conveyance operation ends, the CR motor 71 starts up while the PF motor 91 is operating. In this case, the operation that is started at later timing is the main scanning image formation operation and the operation that is started at earlier timing is the sub-scanning paper conveyance operation. In this case, the PF motor 91 and the paper conveyance mechanism 80 are referred to as "earlier-driven conveyor" that is started at earlier timing, and the CR motor 71 and the carriage conveyance mechanism 60 are referred to as "later-driven conveyor" that is started at later timing.

Figure 8A:
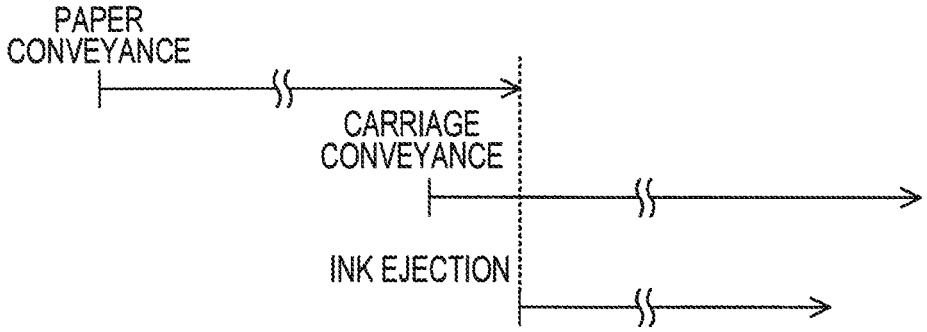
FIG. 8A is an explanatory diagram for illustrating a case where a paper conveyance operation precedes a carriage conveyance operation.

FIG. 8A illustrates a case where the main controller 10 executes the sub-scanning paper conveyance operation (S250) to start the conveyance operation of the paper Q and, before the conveyance operation of the paper Q ends, the main controller 10 executes the main scanning image formation processing (S220) to start conveyance of the carriage 61, and, when the carriage 61 reaches the image formation start position, an ink ejection operation by the recording head 50 is started.

The main controller 10 inputs a stop instruction in S340 to temporarily stop the operation that is started at later timing. After that, the main controller 10 switches the operation mode to the current suppression mode (S350). Then, the processing moves to S360.

In S360, the main controller 10 stands by until the operation that is started at earlier timing ends. When the operation that is started at earlier timing ends, the main controller 10 determines whether the temporarily-stopped operation to be restarted is the sub-scanning paper conveyance operation (S370).

In response to determining that the operation to be restarted is the sub-scanning paper conveyance operation (S370: Yes), the PF motor 91 and the paper conveyance mechanism 80 are operated by the conveyance controller 40 such that the paper Q is conveyed to the downstream side in the sub-scanning direction from the stopped position to a conveyance destination position to which the paper Q would have been conveyed if the paper Q had not been temporarily stopped. With this operation, the main controller 10 causes the PF motor 91 and the paper conveyance mechanism 80 to perform the remaining of the interrupted sub-scanning paper conveyance operation (S380).

In other words, the main controller 10 operates the PF motor 91 and the paper conveyance mechanism 80 such that the paper Q is conveyed to a position at which the conveyance amount of the paper Q from the start of conveyance (including the conveyance amount before temporarily stopping) is equal to the particular amount described above. More specifically, the main controller 10 sets a target profile up to the conveyance destination position to the conveyance controller 40, and causes the conveyance controller 40 to control the PF motor 91.

Figure 7B:
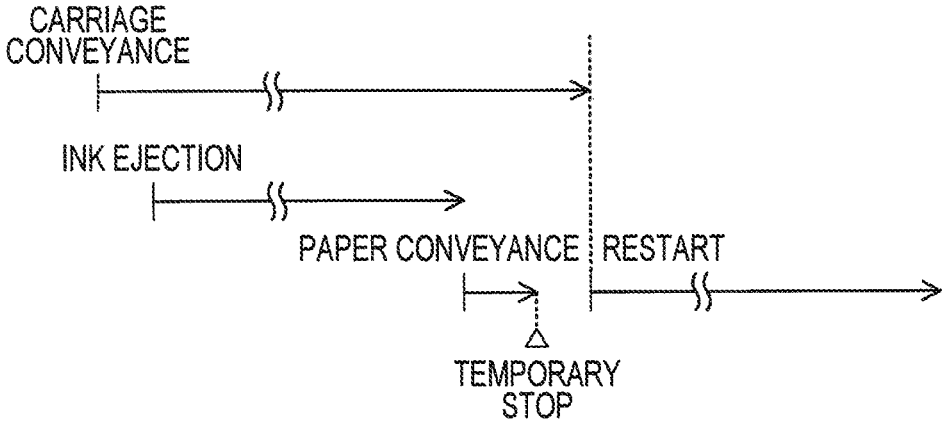
FIG. 7B is an explanatory diagram for illustrating a case where a carriage conveyance operation precedes a paper conveyance operation and the paper conveyance operation includes a temporary stop operation.

When the processing in S380 ends, the main controller 10 temporarily stops the monitor processing. FIG. 7B illustrates a case where the conveyance operation of the temporarily stopped paper Q is restarted after the carriage 61 reaches the turn position and the conveyance operation of the carriage 61 ends.

In response to determining that the operation to be restarted is not the sub-scanning paper conveyance operation but the main scanning image formation operation (S370: No), the main controller 10 determines whether the carriage 61 needs to be moved backward (S390). More specifically, the main controller 10 determines that the carriage 61 needs to be moved backward if not only the conveyance operation of the carriage 61 but also the ink ejection operation has been temporarily stopped due to temporary stop of the main scanning image formation operation.

In a case where the carriage 61 does not shift to the constant velocity state before reaching the image formation start position if the main scanning image formation operation (more specifically, the conveyance operation of the carriage 61) is restarted without moving the carriage 61 backward, the main controller 10 determines that the carriage 61 needs to be moved backward.

In other cases, the main controller 10 determines that the carriage 61 does not need to be moved backward. For example, the main controller 10 determines that the carriage 61 does not need to be moved backward if the stopped position of the carriage 61 is upstream of a restart standard position that is away from the image formation start position to the upstream side in the conveyance direction of the carriage 61 by the distance needed for acceleration. A "distance needed for acceleration" herein refers to a conveyance distance of the carriage 61 that is long enough to allow a stopped carriage 61 to shift to a constant velocity state.

In response to determining that the carriage 61 needs to be moved backward (S390: Yes), the main controller 10 causes the carriage 61 to be moved backward to the restart standard position (the position that is away from the image formation start position to the upstream side in the conveyance direction of the carriage 61 by the distance needed for acceleration) (S400), and then restarts the main scanning image formation operation (S410).

Figure 8B:
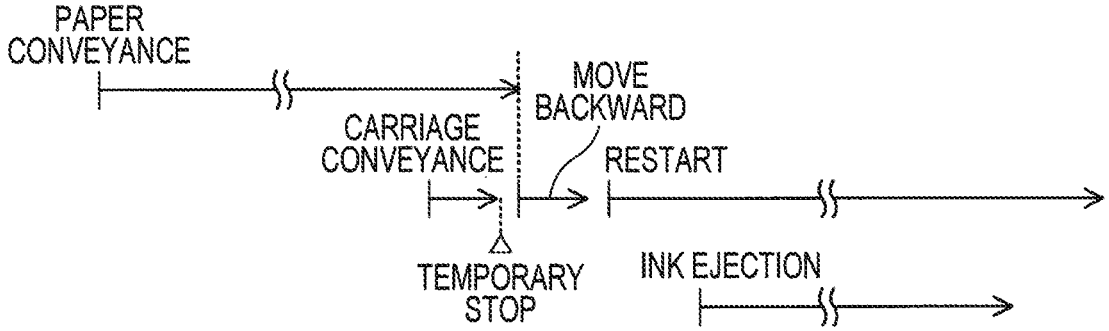
FIG. 8B is an explanatory diagram for illustrating a case where a paper conveyance operation precedes a carriage conveyance operation and the carriage conveyance operation includes a temporary stop operation.

That is, the main controller 10 controls the CR motor 71 and the recording head 50 (S410) through the print controller 30 such that the carriage 61 is conveyed to the downstream side from the position to which the carriage 61 is moved backward and, in this conveyance process, the ink ejection operation that is yet to be performed is performed by the recording head 50. Then, the main controller 10 temporarily stops the monitor processing. FIG. 8B illustrates a case where the temporarily stopped main scanning image formation operation is restarted after the carriage 61 is moved backward after the conveyance operation of the paper Q ends.

As described above, in the monitor processing, the main controller 10 monitors the total value Is of the current supplied to the CR motor 71 and the PF motor 91, and temporarily stops the subsequent operation (that is, the operation that is started at later timing) when the total value Is exceeds the threshold value TH, and restarts the subsequent operation after the preceding operation (that is, the operation that is started at earlier timing) ends. In this way, the main controller 10 controls the image forming system 1 such that the current supplied to the CR motor 71 and the PF motor 91 does not exceed the upper limit of a suppliable current that can be supplied by the common power source 99.

Figure 9:
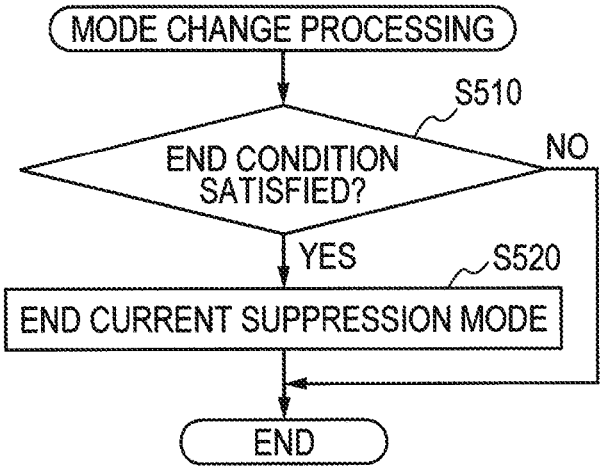
FIG. 9 is a flowchart showing mode change processing that is executed by the main controller.

The main controller 10 also repeatedly performs mode change processing shown in FIG. 9 after switching the operation mode to the current suppression mode, to thereby change the operation mode of the image forming system 1 from the current suppression mode to the normal mode as necessary.

More specifically, the main controller 10 determines whether a predetermined end condition for the current suppression mode is satisfied (S510). In response to determining that the end condition is satisfied (S510: Yes), the main controller 10 changes the operation mode from the current suppression mode to the normal mode (S520) and ends the mode change processing. In response to determining that the end condition is not satisfied (S510: No), the main controller 10 ends the mode change processing without changing the mode and performs the determination in S510 again after some time elapses.

According to this embodiment, although the operation mode is changed to the current suppression mode in S350, the page print processing in the current suppression mode is not performed for the page at which the operation mode is changed to the current suppression mode but performed starting at the page print processing for the next page. Similarly, changing the operation mode in S520 is not reflected in the page print processing until the page of the print target changes. Thus, the mode change processing may be executed each time the page print processing is executed.

The end condition in S510 may be determined based on one or a plurality of parameters including, for example, an elapsed time, the number of printed sheets, temperature, the peak of driving current of each motor, or the control accuracy of the motors.

According to a first example, in S510, the main controller 10 determines whether an elapsed time after the operation mode is changed to the current suppression mode exceeds a particular period of time. If the elapsed time exceeds the particular period of time, the main controller 10 determines that the end condition is satisfied. In the other case, the main controller 10 determines that the end condition is not satisfied. This determination is useful because the cause of an increase in load acting on the motor could be removed by an elapse of time.

According to a second example, in S510, the main controller 10 determines whether the number of printed sheets after the operation mode is changed to the current suppression mode exceeds a particular number of sheets. If the number of printed sheets exceeds the particular number, the main controller 10 determines that the end condition is satisfied.

According to a third example, in S510, the main controller 10 determines whether ambient temperature has increased by a particular temperature or more from the time point at which the operation mode is changed to the current suppression mode. If the ambient temperature has increased by the particular temperature or more, the main controller 10 determines that the end condition is satisfied. Depending on the increase in temperature, the viscosity of lubricant decreases, the friction between moving parts decreases, and the load acting on the motor decreases.

According to a fourth example, in S510, the main controller 10 determines whether the peak value of driving current of each of the CR motor 71 and the PF motor 91 (that is, not the peak value of the total driving current of both motors 71 and 91 but the peak value of driving current of each motor) has decreased by a particular amount or more from the time point at which the operation mode is changed to the current suppression mode. In response to determining that the peak value has decreased by the particular amount or more, the main controller 10 determines that the end condition is satisfied. A decrease in the peak value also indicates a reduction in load.

According to a fifth example, in S510, the main controller 10 determines whether a stop error of the carriage 61 during carriage conveyance and a stop error of the conveyance roller 81 during paper conveyance has decreased by a particular amount or more from the time point at which the operation mode is changed to the current suppression mode. In response to determining that the stop error have decreased by the particular amount or more, the main controller 10 determines that the end condition is satisfied. A decrease in this error also indicates a reduction in load.

According to the above-described image forming system 1 of this embodiment, the main controller 10 determines whether the total value Is=I1+I2 of the driving current I1 of the CR motor 71 and the driving current I2 of the PF motor 91 during operation of the CR motor 71 and the PF motor 91 exceeds the threshold value TH (S330). If the total value Is exceeds the threshold value TH, the operation of the motor that is started up at later timing is temporarily stopped while the operation of the motor that is started up at earlier timing is continued. Then, after the motor that is started up at earlier timing stops and the driving current of the motor that is started up at earlier timing drops to zero, the operation of the motor that is started up at later timing is restarted.

Thus, the common power source 99 having a small suppliable current is used to appropriately operate the plurality of conveyance mechanisms 60 and 80 and to suppress unfavorable events, such as a system error or a fault caused by an insufficient amount of current being supplied to the CR motor 71 and the PF motor 91 from the common power source 99. The image forming system 1 of this embodiment also suppresses shortage of a current that is supplied to the motors from the common power source 99 immediately after restart.

In this embodiment, when a temporary stop occurs, for some period of time, the operation mode is switched to the current suppression mode and the CR motor 71 and the PF motor 91 are controlled such that the total value Is of the driving currents of the CR motor 71 and the PF motor 91 is lower than before changing the mode.

More specifically, a target profile for the current suppression mode is prepared to control the CR motor 71 and the PF motor 91 such that, in the current suppression mode, the conveyance velocity and conveyance acceleration of the carriage 61 and the conveyance velocity and conveyance acceleration of the paper Q are lower than those in the normal mode. Alternatively, in the current suppression mode, the CR motor 71 and the PF motor 91 are controlled such that the CR motor 71 and the PF motor 91 do not operate concurrently.

The above-described control suppresses a situation in which the total value Is exceeds the threshold value TH and a decrease in printing throughput due to numerous occurrences of temporary stops.

In this embodiment, when the conveyance operation for the carriage 61 that includes an ink ejection operation is restarted, the carriage 61 is moved backward to secure an acceleration section. When the above-described control is not needed, the carriage 61 is not moved backward. Regarding the conveyance operation of the paper Q, paper conveyance is restarted from the stopped position. Thus, in this embodiment, temporarily stopped operations can be restarted quickly and efficiently, while suppressing degradation of the quality of an image that is formed on the paper Q due to temporary stops.

In the above-described embodiment, the total value (sum) Is of the driving current I1 and the driving current I2 is used as the reference current value. By performing determination based on the total value Is, shortage of currents supplied from the common power supply 99 to the carriage conveyance mechanism 60 and the paper conveyance mechanism 80 can be suppressed with high reliability.

While the disclosure has been described in detail with reference to the above aspects thereof, it would be apparent to those skilled in the art that various changes and modifications may be made therein without departing from the scope of the claims.

For example, in the above-described embodiment, the operation that is started at later timing is temporarily stopped depending on the result of comparison between the total value Is of the driving currents of the CR motor 71 and the PF motor 91 and the threshold value TH. However, instead of the threshold value TH, only one of the driving current of the CR motor 71 and the driving current of the PF motor 91 may be monitored, and the later-started operation may be temporarily stopped based on whether the monitored driving current exceeds a threshold value.

The driving current to be monitored may be one of the driving current of the CR motor 71 and the driving current of the PF motor 91 that has started an operation at later timing. By setting a threshold value that is sufficiently smaller than the maximum value of the suppliable current of the common power supply 99, power shut off due to an excessively large supply current can be suppressed even through simply monitoring the driving current of one of the motors.

In the above-described embodiment, the temporarily stopped operation is not restarted until the earlier-started operation ends and the earlier-started motor stops. However, the temporarily stopped operation may be restarted before the earlier-started operation ends without waiting for the earlier-started motor to stop. In this case, the temporarily stopped operation may be restarted on condition that the driving current of the earlier-started motor passes a peak and the driving current of the motor drops below a particular standard.

In the above-described embodiment, the operation in accordance with the current suppression mode switched over from the normal mode is not performed until the page print processing for the next page starts. Alternatively, the operation in accordance with the current suppression mode, that is, restriction of velocity and acceleration and restriction of concurrent operations may be performed starting at the main scanning image formation processing and the sub-scanning paper conveyance processing that are executed immediately after changing the mode.

A function of one element in the above-described embodiments may be distributedly provided in a plurality of elements. Functions of a plurality of elements may be integrated into one element. A part of the configuration in the above-described embodiments may be omitted. At least part of the configuration in one embodiment may be added to configurations in another embodiment, or may be replaced by a configuration in another embodiment.

The recording head 50 is a non-limiting example of an ejector. The CR motor 71 and the carriage conveyance mechanism 60 are a non-limiting example of a first conveyor. The PF motor 91 and the paper conveyance mechanism 80 are a non-limiting example of a second conveyor. The main controller 10, the print controller 30, and the conveyance controller 40 are a non-limiting example of a controller.

What is claimed is:

1. An image forming system comprising:

an ejector configured to eject ink toward a sheet;

a first conveyor configured to cause the ejector to reciprocate along a main scanning direction;

a second conveyor configured to convey the sheet in a sub-scanning direction;

a common power supply configured to supply electric power to the first conveyor and the second conveyor; and a controller configured to form an image on the sheet by repeatedly performing operations of controlling the first conveyor to convey the ejector to a turn position along the main scanning direction, controlling the ejector to eject ink toward the sheet in a conveyance process of the ejector, and controlling the second conveyor to convey the sheet in the sub-scanning direction by a particular amount after ejection of ink by the ejector ends, the controller being configured to:

when both the first conveyor and the second conveyor are operating concurrently, determine whether a reference current value exceeds a threshold value, the reference current value being obtained based on at least one of a first driving current that is a driving current of the first conveyor and a second driving current that is a driving current of the second conveyor;

in response to determining that the reference current value exceeds the threshold value, continue an operation of an earlier-driven conveyor that is one of the first conveyor and the second conveyor that is started at earlier timing, and temporarily stop an operation of a later-driven conveyor that is one of the first conveyor and the second conveyor that is started at later timing; and after a driving current of the earlier-driven conveyor drops to a particular standard, restart the operation of the later-driven conveyor.

2. The image forming system according to claim 1, wherein the controller is configured to, after the operation of the earlier-driven conveyor ends, restart the operation of the later-driven conveyor that is temporarily stopped.

3. The image forming system according to claim 1, wherein the reference current value is a total value of the first driving current and the second driving current.

4. The image forming system according to claim 3, wherein the controller is configured to:

shift to a current suppression mode in a case where the total value exceeds the threshold value; and in the current suppression mode, control the first conveyor and the second conveyor such that the total value is smaller than the total value before shifting to the current suppression mode.

5. The image forming system according to claim 4, wherein the controller is configured to, in order to suppress the total value, control the first conveyor and the second conveyor such that a conveyance velocity of at least one of the first conveyor and the second conveyor is lower than the conveyance velocity before shifting to the current suppression mode.

6. The image forming system according to claim 4, wherein the controller is configured to, in order to suppress the total value, control the first conveyor and the second conveyor such that a conveyance acceleration of at least one of the first conveyor and the second conveyor is lower than the conveyance acceleration before shifting to the current suppression mode.

7. The image forming system according to claim 3, wherein the controller is configured to:

shift to a current suppression mode in a case where the total value exceeds the threshold value; and in the current suppression mode, control the first conveyor and the second conveyor such that the first conveyor and the second conveyor do not operate concurrently.

8. The image forming system according to claim 4, wherein the controller is configured to end the current suppression mode in a case where a particular condition is satisfied after shifting to the current suppression mode.

9. The image forming system according to claim 1, wherein the controller is configured to, in a case where the later-driven conveyor is the first conveyor and an ink ejection operation by the ejector is necessary after restart, control, at the restart, the first conveyor to move the ejector backward from a temporary stop position to a particular position and thereafter convey the ejector from the particular position to the turn position, the temporary stop position being a position at which the ejector is stopped temporarily due to a temporary stop of the operation of the first conveyor.

10. The image forming system according to claim 9, wherein the controller is configured to control, at restart, the first conveyor to move the ejector from the temporary stop position to a restart standard position backward to an upstream side and thereafter convey the ejector from the restart standard position to the turn position to a downstream side, the restart standard position being a position away from an image formation start position by a particular distance to the upstream side and a position from which the ejector accelerates to a constant velocity state before the ejector reaches the image formation start position.

11. The image forming system according to claim 10, wherein the controller is configured to, in a case where the temporary stop position of the ejector is farther upstream than the restart standard position, control, at the restart, the first conveyor to convey the ejector from the temporary stop position to the turn position to the downstream side without moving the ejector backward.

12. The image forming system according to claim 9, wherein the controller is configured to, in a case where the later-driven conveyor is the second conveyor, control the second conveyor to convey the sheet from a temporary stop position to a position that a total conveyance amount of the sheet becomes the particular amount, the total conveyance amount of the sheet being a conveyance amount from start of conveyance including a conveyance amount before the temporary stop and a conveyance amount after the temporary stop.

13. The image forming system according to claim 1, wherein the reference current value is one of the first driving current and the second driving current.

14. The image forming system according to claim 1, wherein the reference current value is a driving current of the later-driven conveyor.

15. The image forming system according to claim 1, wherein the controller is configured to restart the operation of the later-driven conveyor that is temporarily stopped, on condition that the driving current of the earlier-driven conveyor passes a peak and drops below a particular standard.

16. The image forming system according to claim 8, wherein the controller is configured to determine whether the particular condition is satisfied, based on one or a plurality of parameters including:

an elapsed time after shifting to the current suppression mode;

a number of printed sheets after shifting to the current suppression mode;

an increase of ambient temperature after shifting to the current suppression mode;

a decrease of a peak value of each of the first driving current and the second driving current after shifting to the current suppression mode; and a decrease of a stop error of the first conveyor and a decrease of a stop error of the second conveyor after shifting to the current suppression mode.

* * * * *